US005555609A

United States Patent [19]

Tolfsen et al.

[11] Patent Number: 5,555,609

[45] Date of Patent: Sep. 17, 1996

[54] SAFETY BELT BUCKLE

[75] Inventors: Ulf Tolfsen, Gamle Fredrikstad, Norway; Magnus Dahlēn, Lefum, Sweden

[73] Assignee: Autoliv Development AB, Vargarda, Sweden

[21] Appl. No.: 244,670

[22] PCT Filed: Oct. 6, 1993

[86] PCT No.: PCT/SE93/00812

§ 371 Date: Sep. 2, 1994

§ 102(e) Date: Sep. 2, 1994

[87] PCT Pub. No.: WO94/08480

PCT Pub. Date: Apr. 28, 1994

[30] Foreign Application Priority Data

Oct. 9, 1992 [GB] United Kingdom ..... 9221214
Oct. 9, 1992 [GB] United Kingdom ..... 9221216

[51] Int. Cl.[6] ..... A44B 11/26

[52] U.S. Cl. ..... 24/641; 24/633

[58] Field of Search ..... 24/633, 641, 640, 24/642, 637, 645

[56] References Cited

U.S. PATENT DOCUMENTS

| | | | |
|---|---|---|---|
| 5,008,989 | 4/1991 | Wedler et al. | 24/633 X |
| 5,133,115 | 7/1992 | Bock | 24/633 |
| 5,195,224 | 3/1993 | Bock et al. | 24/633 |
| 5,216,788 | 6/1993 | Bock | 24/641 X |
| 5,280,669 | 1/1994 | Nanbu et al. | 24/641 |
| 5,369,855 | 12/1994 | Tokugawa | 24/637 X |

FOREIGN PATENT DOCUMENTS

| | | | |
|---|---|---|---|
| 0083752 | 7/1983 | European Pat. Off. . | |
| 3822483 | 4/1990 | Germany . | |
| 448595 | 3/1987 | Sweden . | |
| 460250 | 9/1989 | Sweden . | |
| 2202264 | 9/1988 | United Kingdom . | |
| 2227513 | 8/1990 | United Kingdom | 24/641 |
| 2264329 | 8/1993 | United Kingdom . | |
| 90/10397 | 9/1990 | WIPO . | |

*Primary Examiner*—James R. Brittain
*Attorney, Agent, or Firm*—Spencer & Frank

[57] ABSTRACT

A safety belt buckle for receiving and retaining a tongue includes a housing defining a path therein to receive the tongue. A main locking element is movable between a release position in which it does not engage the tongue, and a locking position in which it engages the tongue to retain the tongue in the buckle. A push button is movable along a longitudinal axis of the path and is positioned above the main locking element. A second locking element is mounted to the housing between the push button and the main locking element, and includes a first portion engagable by the push button, and a second portion movable to a first position to engage the main locking element to prevent movement of the main locking element to the release position. The second portion and the push button are movable along the longitudinal axis of the path in opposite directions when the main locking element is to be released so that the second portion is moved to a second position in which the main locking element is freed. When the second portion is in the first position, the first portion is engaged by and limits movement of the push button when the buckle is subjected to a g-force acting in a first direction. The push button engages with and prevents movement of the second locking element when the buckle is subjected to a g-force acting in a second direction opposite to first direction.

21 Claims, 5 Drawing Sheets

FIG 2
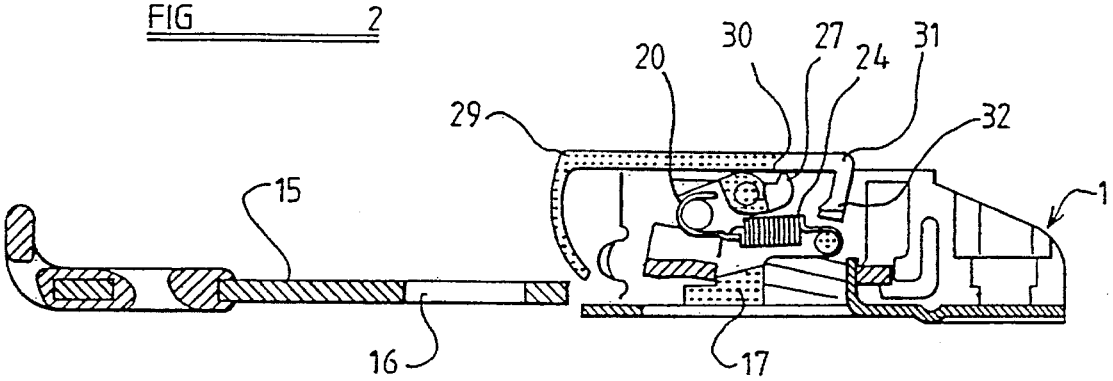
FIG 3
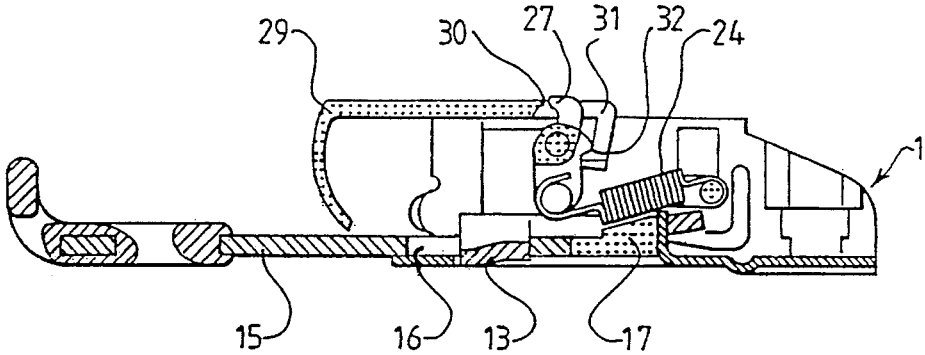
FIG 4
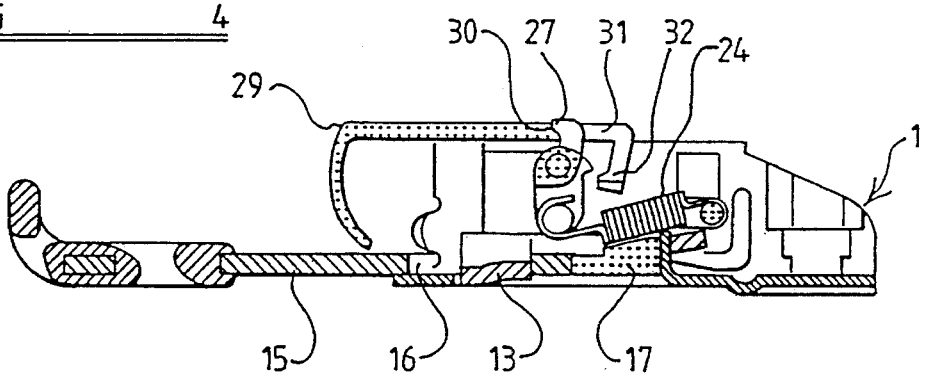
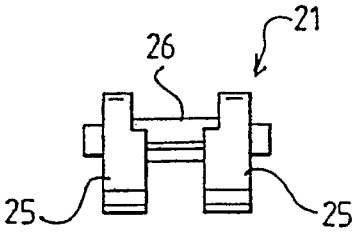
FIG 5
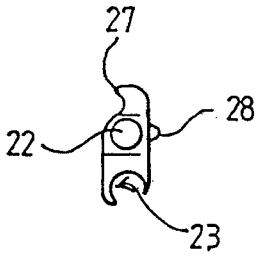
FIG 6

SAFETY BELT BUCKLE

BACKGROUND OF THE INVENTION

THE PRESENT INVENTION relates to a safety belt buckle.

It is well known to provide a safety belt buckle which receives a tongue connected to part of a safety belt and retains the tongue within the buckle. The buckle usually has a push button which can be manually operated in order to release the tongue from the buckle.

The tongue is usually retained within the buckle by means of a latch or locking element which is movable between a latching position and a release position. This invention relates to a particular type of buckle known as a "servo buckle" in which the latch or locking element will tend to move to the release position when the tongue is moved in a direction tending to withdraw it from the buckle i.e. when tension is applied to the safety belt. In this type of buckle a second locking element is provided in order to retain the latch or main locking element in the locking position, the second locking element being movable by way of the push button so as to permit the latch or main locking element to move to the release position.

In some servo buckles the push button and the second locking element move in the same direction when the main locking element is moved to the release position and with this type of design the buckle can only be opened by a force acting to move the push button and/or the second locking element in one direction.

In other designs of servo buckle the push button and the second locking element move in opposite directions when the main locking element is to be moved to the release position and with this type of buckle design the buckle could be opened as a result of forces acting either in the direction of movement of the push button or of the second locking element. These components normally move parallel to the longitudinal axis of the buckle. Thus, the buckle must be able to withstand high accelerations in either direction along the main axis of the buckle. This is particularly important for buckles provided with a safety belt pre-tensioner device which, when activated, imparts a high acceleration to the buckle in one direction along its axis.

This invention is particularly concerned with servo buckles in which the push button moves in the opposite direction to the second locking element (when considered axially of the buckle) when the main locking element is to move to the release position.

With this type of servo buckle it is possible for the push button and the second locking element to be "mass-balanced", that it to say the mass of the push button and the second locking element and their positioning relative to each other within the buckle may be selected so that if the buckle is subjected to a high acceleration in either direction along its longitudinal axis the push button and the second locking element will act against each other to prevent movement of either component which could result in the main locking element being freed to move to the release position. Such an arrangement is considered as being "g-safe".

Various g-safe servo buckle designs are known and one such buckle is disclosed in DE-OS 3 833 483. In the embodiment shown in FIGS. 1 to 3 of this document the second locking element takes the form of a pair of levers which pivot about a vertical axis through the buckle. There is a fixed connection between a push button and the second locking element and also between a separate balancing mass and the second locking element. Whilst this arrangement is g-safe, the fixed connections between the push button and the second locking element means that the push button remains in a depressed position once it has been actuated in order to open the buckle. Such an arrangement is not acceptable to the automotive industry where it is required that the push button should return to its initial position after it has been pushed in in order to open the buckle.

Further g-safe servo buckle arrangements are disclosed in DE-OS 4 007 915 and DE-OS 4 007 916, but again the arrangements disclosed in these documents suffer from the same problems outlined above.

SUMMARY OF THE INVENTION

The present invention seeks to provide an improved safety belt buckle which addresses the problems mentioned above.

According to this invention there is provided a safety belt buckle for receiving and retaining a tongue mounted on the safety belt comprises a housing defining a path to receive the tongue; a main locking element movable between a release position in which it does not engage the tongue and a locking position in which it engages the tongue to retain the tongue in the buckle; a second locking element which engages the main locking element when in the locking position and prevents movement of the main locking element to the release position, the second locking element being movable to a position in which the main locking element is freed so as to be movable to the release position; and a push button adapted to move the second locking element, the push button and that part of the second locking element which engages the main locking element moving in opposite directions (considered axially of the buckle) when the main locking element is to be released; the second locking element being engaged by and limiting movement of the push button when the buckle is subjected to a g-force acting in a first direction and the push button engaging and preventing movement of the second locking element when the buckle is subjected to a g-force acting in the opposite direction to said first direction.

Preferably the push button and the second locking element engage each other at different, spaced apart contact points when the buckle is subjected to g-forces acting in said first and said opposite directions, the arrangement being such that different mechanical advantages are achieved through the two different contact points.

Conveniently the second locking element comprises a pivoting lever.

Advantageously the center of mass of the pivoting lever is offset from the pivot axis thereof and when the buckle is subjected to g-forces acting in said first or said opposite direction the second locking element is subjected to opposing torques acting about its pivot axis, the torques being generated by the engagement of the second locking element with the push button and by the mass of the second locking element itself.

Preferably when the buckle is subjected to a g-force acting in said first direction, the torque exerted on the second locking element as a result of the mass of the second locking element is greater than the torque exerted on the second locking element by the engagement of the push button therewith.

In addition, it is convenient that when the buckle is subjected to a g-force acting in said opposite direction the torque exerted on the second locking element by the engagement of the push button therewith is greater than the torque exerted on the second locking element due to the mass of the second locking element.

In one embodiment, the point at which the push button engages the second locking element, when the buckle is subjected to a g-force in said opposite direction, is further away from the pivot axis of the second locking is engaged by the push button when the buckle is subjected to a g-force in said first direction.

In another embodiment, when the buckle is subjected to a g-force acting in said opposite direction, the push button engages the second locking element via a surface of the second locking element which is not perpendicular to the direction of movement of the push button.

In this other embodiment, said surface of the second locking element via which the push button engages the second locking element may be inclined to the direction of movement of the push button.

Alternatively said surface of the second locking element via which the push button engages the second locking element may be substantially parallel to the direction of movement of the push button.

Preferably when the buckle is subjected to a g-force acting in said first direction the push button may move through a predetermined distance before engaging the second locking element.

The second locking element may be urged against a stop by means of a spring when it is in the locking position, the stop being movable when subjected to a g-force acting in said first direction so as to permit movement of the second locking element under the action of the spring before it is engaged by the push button, the movement of that part of the second locking element which is engaged by the push button being in the opposite direction to movement of the push button.

Preferably the stop is acted upon by spring means so as to be biased in the opposite direction to the bias imparted to the second locking element by the spring.

Conveniently the spring extends between the push button and the lever constituting the second locking element.

In one arrangement the stop may be connected to an ejector provided in the buckle for ejecting the tongue therefrom.

In another arrangement the stop may be defined by part of the main locking element, the main locking element being resiliently mounted within the housing of the buckle.

In a preferred arrangement the second locking element incorporates a pin-like member which engages the main locking element when in the locking position and prevents movement of the main locking element to the release position, part of the pin-like member being received in an aperture in part of the buckle housing (1) with any forces which tend to urge the main locking element to the release position being transmitted to the housing via the pin-like member.

Conveniently the pin-like member is mounted adjacent one end of the lever, movement of the push button being transmitted to the pin-like member via the lever.

Advantageously any forces which tend to urge the main locking element to the release position are transmitted into the housing of the buckle at a position offset from the point where the lever is pivotally mounted in the housing, said forces being transmitted into the housing through the pin-like member and an edge of the aperture in which part of the pin-like member is received.

The pin-like member may be formed integrally with the lever or may be formed separately from the lever and is received within a recess defined by the lever.

BRIEF DESCRIPTION OF THE DRAWING

In order that the present invention may be more readily understood and so that further features thereof may be appreciated, the invention will now be described by way of example, with reference to the accompanying drawings in which;

FIG. 2 is a longitudinal cross-sectional view through a buckle in accordance with this invention showing the buckle in the released position;

FIG. 3 is a cross-sectional view corresponding to FIG. 2 but showing the buckle in the locked position in which a safety belt tongue is retained therein;

FIG. 4 is a further cross-sectional view corresponding to FIGS. 2 and 3 but showing the buckle when the push button has just started to move towards the release position;

FIG. 5 is a side view of a lever forming part of the buckle;

FIG. 6 is an end view of the lever of FIG. 5;

DETAILED DESCRIPTION OF THE INVENTION

Figure 1:
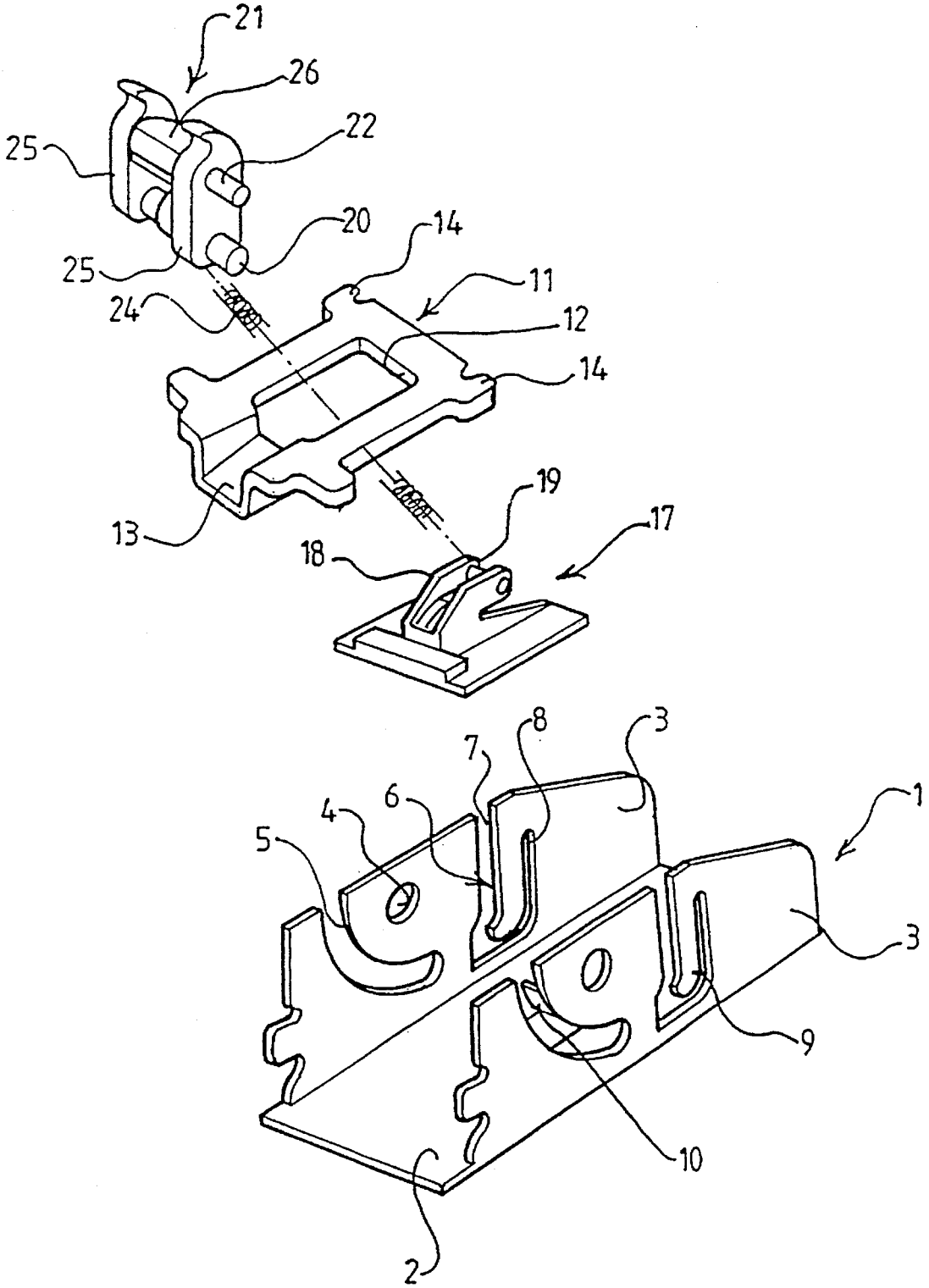
FIG. 1 is an exploded perspective view showing some of the parts of a buckle in accordance with this invention.

Referring initially to the buckle illustrated in FIGS. 1 to 8 of the accompanying drawings, this buckle comprises a channel-shaped housing 1 having a base 2 and upstanding opposed side walls 3. The side walls stand at right angles to the base and are both of the same form, each defining a number of apertures which serve to receive other parts of the buckle.

Thus each side wall defines a circular aperture 4 adjacent its upper edge at approximately the mid-point along its length and an arcuate slot 5 which extends around the aperture 4 from the upper edge of the side wall through an angle of approximately 90°. In addition each side wall defines, to the rear of the aperture 4 and slot 5, an opening 6 having a first vertical portion 7 which extends downwardly from the upper edge of the side wall and a second, parallel vertical portion disposed to the rear of the first portion, the second portion 8 extending upwardly and terminating at a position spaced from the upper edge of the side wall. Between the first and second portions 7, 8 of the opening 6 each side wall 3 defines a slightly resilient depending limb 9.

The base of the buckle is generally rectangular and the side walls 3 extend upwardly from the longer opposed edges of the base. Part of a central region of the base 2 is deflected upwardly into the channel to form a projection 10 which serves to locate other components within the channel.

It should be appreciated that FIG. 1 is only a schematic illustration and, in practice, the housing 1 would look somewhat different. Thus the housing would have outwardly directed flanges extending laterally from the top of each side wall 3, as well as other features not specifically illustrated or described here.

It is to be understood that when reference is made to the front and rear of the buckle in this description, the front of the buckle is the left hand end of the buckle whilst the rear of the buckle is the right hand end of the buckle as seen in FIGS. 1 to 4 of the drawings.

The buckle has a main locking element in the form of a latching member 11 which extends across the width of the channel. The latching member 11 has a main body defining a substantially rectangular aperture 12. The front end of the latching member defines a downwardly deflected portion 13 which forms the locking catch of the latching member. The latching member is mounted within the channel housing 1 so that the upstanding protection 10 in the base 2 passes through the aperture 12 adjacent the rear of latching member 11 and so that rearwardly directed lugs 14 formed on the latching member pass into the openings 6 formed in the side walls 3. The latching member is actually introduced into the channel by passing the lugs 14 into the openings 6 via the open upper end of the first portion 7 and sliding the lugs downwardly which eventually causes the resilient limbs 9 to flex rearwardly so that the lugs 14 snap into position at the base of the openings 6 and are then held in place. The latching member is now rotatably mounted within the channel and may pivot about an axis extending transversely across the channel at the rear of the latching member. Thus the front end of the latching member which carries the locking catch 13 may be moved between raised and lowered positions corresponding to the released and locking positions of the buckle.

A locking tongue 15 (see FIGS. 2, 3 and 4) which is connected to a safety belt, such as a vehicle seat belt, may be retained in the buckle by means of the latching member 11, the locking catch 13 of which passes into an aperture 16 defined by the locking tongue when in the lowered position with the tongue received in the buckle.

The tongue 15 is inserted into the buckle along the upper surface of the base 2 which effectively defines a path to receive the tongue. When the tongue is received in the buckle and retained in position by the locking catch 13 of the latching member 11, the latching member engages the tongue at a position just above the upper surface of the base 2. As can be seen best from FIG. 3, the pivot axis of the latching member is located above the level of the tongue 15 and above the level of the point of engagement between the locking catch 13 and the tongue and thus forces exerted on the latching member by the tongue due to tension in the safety belt result in a torque on the latching member which acts to rotate it in a clockwise direction about its pivot axis. Thus such forces act to raise the locking catch 13 and move the latching member to the release position.

A spring-biased tongue ejector 17 is located on the base of the channel housing beneath the latching member 11 and serves to bias the tongue 15 out of the buckle in a known manner. Thus, even when there is little or no tension in the safety belt to which the tongue 15 is connected, the ejector 17 exerts a force on the locking catch 13 through the tongue 15 which gives rise to a torque acting to rotate the latching member to the release position.

The ejector has a pair of upwardly and rearwardly extending arms 18 which pass up through the aperture 12 in the main body of the latching member and which are interconnected by a rod or pin 19 which extends transversely of the buckle between the two arms 18.

In order to prevent the latching member 11 from moving to the release position there is provided a second locking element in the form of a lever having a circular-section pin 20, the pin 20 extending transversely across the buckle and engaging the upper surface of the latching member at a position towards the front of the member. The pin 20 is received in the lower end of the lever 21 which is pivotally supported within the channel housing 1 of the buckle by way of journals 22 which extend into the circular apertures 4 in the side walls 3. Thus the lever 21 extends transversely across the channel housing, as does the pin 20. Whilst the pin 20 has been identified as the second locking element, either the pin or the complete lever 21 incorporating the pin may be regarded as the second locking element. The pin 20 is received with an appropriately configured recess 23 formed at the lower end of the lever 21. The pivot axis of the lever is disposed between the upper and lower ends thereof at a position just above the middle of the lever as seen in side view in FIGS. 2 and 3.

The ends of the pin 20 project beyond the lever 21 and are received within the arcuate slots 5 formed in the side walls 3. Thus, the slots 5 define a predetermined path of movement for the pin 20 as the lever 21 rotates about its pivot axis defined by the journals 22 and the apertures 4 in the housing.

When the lever 21 is mounted in the buckle housing it is positioned in front of the pin or rod 19 on the ejector 17 and a tension spring 24 extends from the pin 20 to the pin 19 on the ejector 17, the spring 24 acting to draw the two pins 19, 20 together. Thus, the spring acts to bias the ejector 17 towards the front of the buckle and to pull the pin 20 towards the rear of the buckle, thereby rotating the lever 21 in an anti-clockwise direction about its pivot axis.

As can clearly be seen in FIG. 5 of the drawings the lever 21 comprises two upstanding lever portions 25 which are interconnected by a transverse element 26 which is aligned with the journals 22. It is in fact the lower region of the two lever portions 25 which define the recess 23 within which the pin 20 is accommodated. The upper region of each lever portion 25 is of hook-like form, defining a hook-like projection 27 which is directed towards the front of the buckle. This forwardly directed hook-like projection is positioned just above the level of the upper edges of the side walls 3 of the buckle housing when the buckle is in the locked position as shown in FIG. 3. The transverse portion 26 of the lever defines a rearwardly directed lip or ridge 28.

A push button 29 is mounted upon the buckle housing for axial sliding motion relative thereto, in a conventional manner. The push button 29 is used in order to release the tongue 15 from the buckle. Part of the push button 29 extends transversely across the top of the channel housing, resting upon the upper edges of the side walls 3. This part of the button defines a rearwardly facing surface 30 designed to engage and cooperate with the forwardly directed hook-like projection 27 defined by the lever 21. In addition the push button 29 has a portion which extends further rearwardly and downwardly as shown by the reference numeral 31, the rearmost portion of the push button carrying a forwardly directed foot 32 which is designed to be received beneath the rearwardly directed lip or ridge 28 of the lever 21 when the buckle is in the locked position, as shown in FIG. 3. The push button 29 is biassed towards the left in FIGS. 2 and 3 by means of a spring or the like which is not illustrated in the drawings. In FIG. 4 the push button has been manually moved to the right. The push button would not normally remain in the position shown in FIG. 2 but would be urged to the left.

FIG. 2 shows the arrangement of the buckles when it is not in use and it is in the released position. As mentioned above the push button 29 would normally be displaced slightly further to the left. The latching member is in the raised position with a front edge of the ejector 17 located beneath and in engagement with the locking catch 13 thereof. The lever 21 has been rotated in an anti-clockwise direction so that the pin 20 is positioned approximately mid-way around the arcuate slot 5 and the spring 24 has contracted and is in a relaxed or only very slightly tensioned condition. It is, of course, the contraction of the spring 24 which has drawn the ejector 17 forwards within the buckle.

Upon insertion of the tongue 15 into the buckle the ejector 17 is pushed rearwardly, thereby causing the spring 24 to be extended. This tensioning of the spring draws the pin 20 back along the arcuate slot 5, with the lever 21 rotating in an anti-clockwise direction. The engagement of the pin 20 with the upper surface of the latching member 11 causes the front end of the latch carrying the downwardly depending locking catch 13 to be moved in a downwards direction so that the locking catch passes into the aperture 16 formed in the tongue.

When tension is applied to the safety belt, tending to pull the tongue 15 out of the buckle, the rear edge of the locking catch 13 engages the edge of the aperture 16 and prevents the tongue from being withdrawn from the buckle. As the lever 21 is rotated in an anti-clockwise direction upon insertion of the tongue 15 the forwardly directed hook-like projection 27 at the top of the lever engages the rearwardly directed surface 30 of the push button 29 and urges the push button to the left. Simultaneously the foot 32 on the rearward extension of the push button 29 is drawn forwardly until it is engaged beneath the lip or ridge 28 defined by the lever, thereby preventing clockwise rotation of the lever. As can be seen from FIG. 3 of the drawings there is a small clearance between the rearwardly directed surface 30 of the push button and the forwardly directed hook-like projection 27 on the lever when the buckle is in the locked position.

When the tongue 15 is to be released from the buckle the push button 29 is moved rearwardly of the buckle i.e. to the right of its position shown in FIG. 3. FIG. 4 illustrates the buckle when the push button has been moved to the right by a distance equal to the clearance normally present between the surface 30 and the hook-like projection 27. As can be seen the clearance between the rearwardly directed surface 30 and the forwardly directed hook-like projection 27 on the lever 21 enables the foot 32 to be released from beneath the lip or ridge 28 before the surface 30 actually engages the top edge of the lever and starts to rotate the lever 21 in a clockwise direction. This rotation of the lever causes the spring 24 to be extended as the pin 20 moves around the arcuate slot 5. The extension of the spring 24 results in the ejector 17 being drawn to the front of the buckle. As explained above the latching member 11 will normally move to the release position if it is not held in the locking position by the pin 20 and thus the latching member moves upwardly as the ejector ejects the tongue 15 from the buckle and holds the latching member in the raised or release position. A biassing spring returns the push button 29 to its initial position.

It will be appreciated from the above description that if the tongue 15 is to be released from the buckle the push button 29 must move towards the back of the buckle whilst the pin 20 must move towards the front of the buckle, i.e. the lever 21 must rotate in a clockwise direction. The centre of gravity of the combined lever 21 and pin 20 (i.e. of the second locking element) is located beneath the pivot axis defined by the journals 22. By appropriate selection of the mass of the push button 29 and the lever 21 and pin 20 and their positioning relative to each other within the buckle, the buckle is "g-safe", or "mass-balanced", that is to say the push button and the second locking element are balanced against each other so that the buckle will not move to the released position under the action of sudden g-forces in either direction axially of the buckle. The push button and the second locking element are in fact designed to be "over-balanced" such that in an accident situation when the buckle is subjected to high axial acceleration in one direction the inertia forces of the second locking element will predominate whilst, when the buckle is subjected to a high axial acceleration in the other direction, the inertia forces of the push button will predominate.

Figure 8:
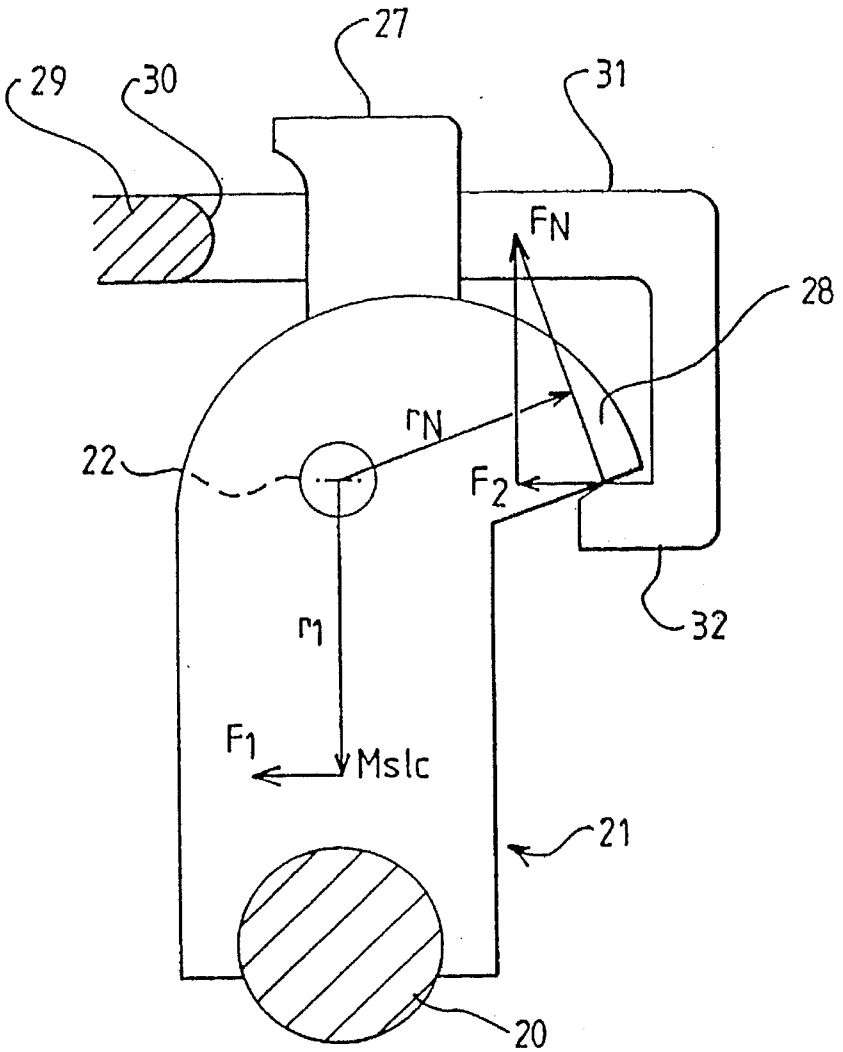
FIGS. 7 and 8 are diagrammatic cross-sectional views illustrating the forces and the torques on certain components of the buckle when in use.
Figure 7:
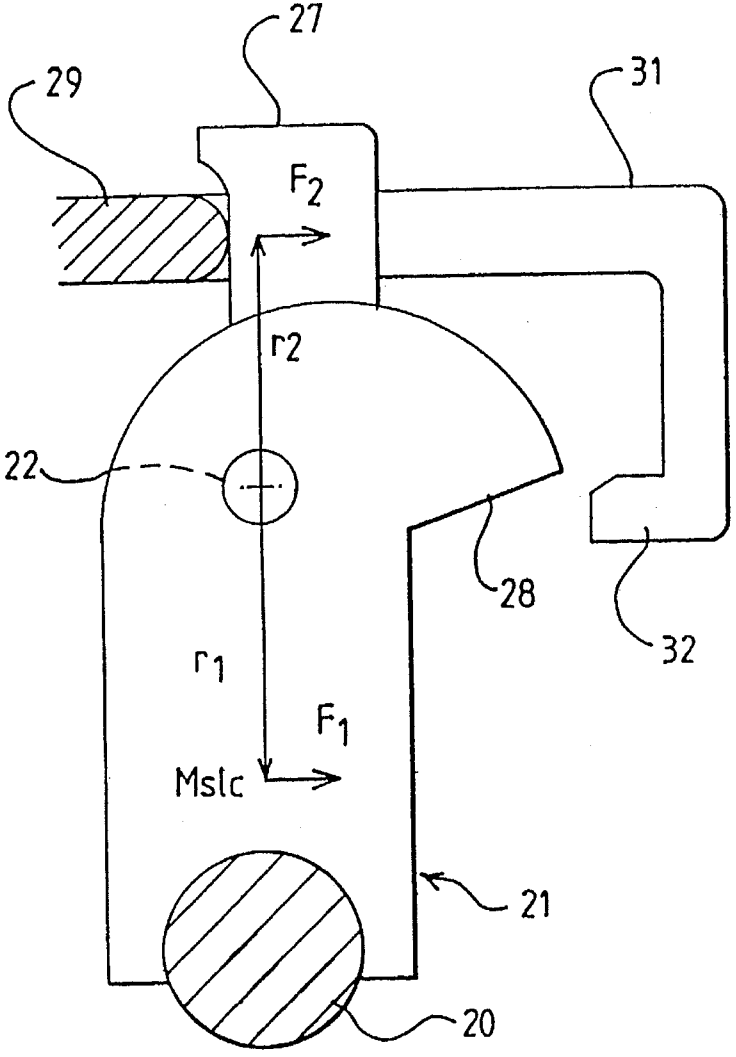

FIGS. 7 and 8 illustrate the forces acting on the second locking element and the resulting torque acting thereon when the buckle is subjected to high axial acceleration.

In FIG. 7 of the drawings the buckle is subjected to a high acceleration acting to the left in the drawing i.e. towards the front of the buckle. This causes the push button to move to the right relative to the remainder of the buckle as a result of its inertia so that the surface 30 engages the hook-like projection 27 at the top of the lever 21 and exerts a torque on the lever tending to rotate it in a clockwise direction about its pivot axis. This torque is equal to the force $F_2$ multiplied by the moment arm $r_2$ as shown in FIG. 7. The force $F_2$ is equal to the mass of the push button 29 multiplied by the acceleration. The centre of mass of the second locking element is located beneath the pivot axis of the lever and when the buckle is subjected to an acceleration towards the left this gives rise to a torque tending to rotate the second locking element in an anti-clockwise direction. This torque is equal to the force $F_1$ multiplied by the moment arm $r_1$ as shown in FIG. 7. The force $F_1$ is equal to the mass of the second locking element multiplied by the acceleration. The push button and the second locking element are designed so as to be "over-balanced", with the torque exerted by the mass of the second locking element $F_1.r_1$ being greater than that torque exerted by the push button, $F_2$. $r_2$ so that the second locking element prevents continued movement of the push button to the right beyond the position shown in FIG. 7, thereby retaining the pin 20 in the position which holds the main locking element in the latching position.

FIG. 8 illustrates what happens when the buckle is subjected to a high acceleration acting towards the right. In this case the inertia of the push button 29 causes it to move towards the left relative to the buckle so that the foot 32 at the rear of the push button is thrust against the under surface of the ridge 28. As can clearly be seen in FIGS. 7 and 8 of the drawings, this under surface of the ridge 28 is inclined so that although the push button 29 is moving towards the left and a force is transmitted to the second locking element in this direction, the force has a component acting at right angles to the surface and this is identified in FIG. 8 as $F_N$. This force exerts a torque on the second locking element equal to $F_N$ multiplied by its associated moment arm $r_N$ which tries to rotate the second locking element in an anti-clockwise direction. At the same time the mass of the second locking element gives rise to a torque acting about the pivot axis of the lever tending to rotate it in a clockwise direction. This torque is equal to $F_1$ multiplied by the moment arm $r_1$ i.e. the torque is the same as that which arises in the situation shown in FIG. 7 but acts to rotate the second locking element in the opposite direction. The inclined nature of the under surface of the ridge 28 results in a force acting normally to that surface, $F_N$, which is significantly greater than the axial force $F_2$ which is transmitted to the lever by the push button and which is equal to the mass of the push button multiplied by the acceleration. The arrangement is designed such that the torque which tends to rotate the second locking element in the anti-clockwise direction, $F_N.r_N$, is greater than the torque tending to rotate the second locking element in the clockwise direction, $F_1.r_1$. Thus the overall result is that the second locking element is retained in the position in which the pin retains the main locking element in the latching position.

It will be appreciated that in the two different situations illustrated in FIGS. 7 and 8 and described above, the second locking element is, in each case, subjected to counteracting torques generated by the push button and by its own mass. The ratio of the torque exerted by the push button to the torque exerted by the mass of the second locking element differs in the two different situations so that when the buckle is subjected to axial acceleration in one direction it is the torque resulting from the mass of the second locking element itself which predominates whereas when the buckle is subjected to axial acceleration in the opposite direction it is the torque exerted by the push button which predominates and in any event the resultant torque acts to urge the second locking element to rotate in an anti-clockwise direction. In the two different situations the torque exerted on the second locking element by the push button is generated through the engagement of the push button with the second locking element at two different, spaced apart contact points, there being a different mechanical advantage through each of the two contact points.

It is to be appreciated that the push button and the second locking element could be designed so that the opposing torques generated by these components about the pivot axis of the lever are equal, thereby giving no resultant torque on the second locking element. It would of course also be possible for the arrangement to be designed so that the opposing torques are equal when the buckle is subjected to high acceleration in one direction but one of the torques is dominant when the buckle is subjected to high acceleration in the other direction. Thus, one may refer to the push button and the second locking element as being balanced or to the push button being over-balanced by the second locking element i.e. the torque resulting from the mass of the second locking element being greater than the torque resulting from the mass of the push button or vice-versa.

It will also be appreciated from the above description that any forces tending to urge the latching member to the raised or release position are transmitted to the buckle housing 1 via the pin 20. Thus any such forces would be transmitted from the latching member through the pin 20 and into the housing via the edges of the arcuate slots 5 and not via the main body of the lever 21. This means that the lever 21 need not be made very strong and may, therefore, be formed from a plastics material. This results in a lever which is significantly lighter than would be the case if it were necessary to make a stronger lever of metal. It is envisaged that the pin 20 will itself be formed of metal and whilst an arrangement has been described in which the pin is formed separately to the lever 21, the lever and pin could be formed integrally of metal with the main part of the lever being relatively thin since it does not have to convey any significant forces to the buckle housing. In any event it will be appreciated that forces tending to move the latching member of the released position are transmitted into the buckle housing by the pin 20 at a position offset from the journals 22 which define the pivot axis of the lever.

Figure 9:
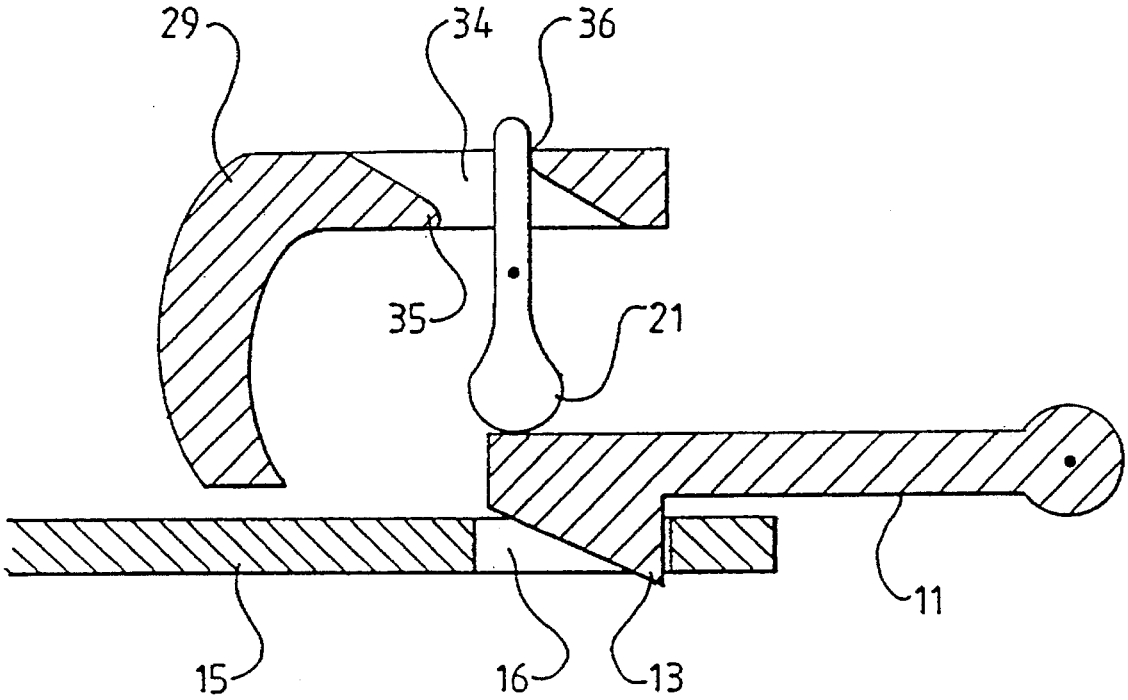
FIG. 9 is a diagrammatic cross-sectional view showing some of the parts of an alternative embodiment of a buckle in accordance with this invention.

FIG. 9 is a diagrammatic longitudinal cross-sectional view showing the main components of an alternative embodiment. For ease of description the same reference numerals are used to identify parts corresponding with parts described in relation to FIGS. 1 to 8. In this modified arrangement a tongue 15 is again retained within the buckle by means of a main latching member 11 which has downwardly directed locking catch 13 which passes into an aperture 16 formed in the tongue. The main locking member is pivotally mounted at the rear of the buckle housing so as to be movable between raised and lowered positions corresponding to the release and locking positions.

In this modified embodiment the second locking element which serves to retain the main latching member 11 in the locking position again comprises a lever 21 pivotally mounted in the buckle housing so that its lower end normally engages the upper surface of the front of the latching member 11. The tongue 15 may be released from the buckle by means of a push button 29. A rearwardly extending part of the push button defines an inclined aperture 34, which is inclined upwardly in a direction from the rear towards the front of the buckle and the upper end of the lever 21 passes through this aperture. The inclined aperture 34 therefore has a front surface 35 and a rear surface 36, which define points of contact with the second locking element when the push button is moved to the left or the right.

This alternative embodiment works in the same way as the previously described embodiment with the lower edge of the front surface 35 and the upper edge of the rear surface 36 of the aperture 34 constituting two different contact points through which the push button exerts a torque on the lever 21 when the buckle is subjected to acceleration in different axial directions. It will be readily appreciated from FIG. 9 that the two different points of contact are at differing distances from the pivot axis of the lever 21 and thus differing torques are exerted by the push button on the lever 21 when the buckle is subjected to acceleration in different axial directions. The arrangement is again designed so that, in any event the torques exerted on the second locking element by the push button and by the mass of the second locking element itself result in the second locking element being urged in a anti-clockwise direction so that the buckle remains in the locked position.

The "mass balancing" of the buckle components as discussed above relates to the balancing of static forces. In some circumstances dynamic forces will come into play however. Thus, if in the arrangement of FIG. 9 a sudden high g-force acts on the push button 29 in a direction towards the right (that is to say in the opening direction) then the push button will be accelerated and reach a certain velocity before it engages the lever 21. This will result in a dynamic force being applied to the lever 21 by the push button 29 in addition to the static g-force resulting from the mass of the push-button. It is therefore necessary to compensate for the dynamic force as well as the static force if it is to be ensured that clockwise rotation of the lever 21 towards the release position is prevented.

It is to be noted that dynamic forces will only have a material effect when g forces are applied very suddenly. If g forces are applied gradually then the push button will move slowly to the right and will engage the lever the lever 21 at low velocity in which case the dynamic forces will be negligable and will not need to be compensated for. Thus it is only in certain circumstances that the dynamic forces must be counteracted.

Figure 10:
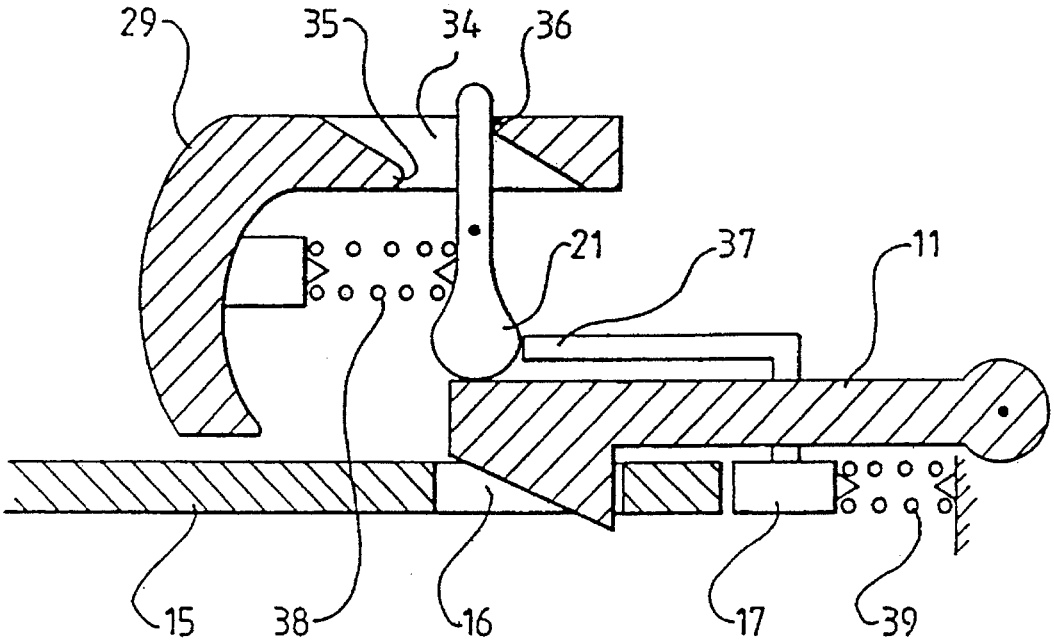
FIGS. 10 and 11 show modified versions of the embodiment of FIG. 9.
Figure 11:
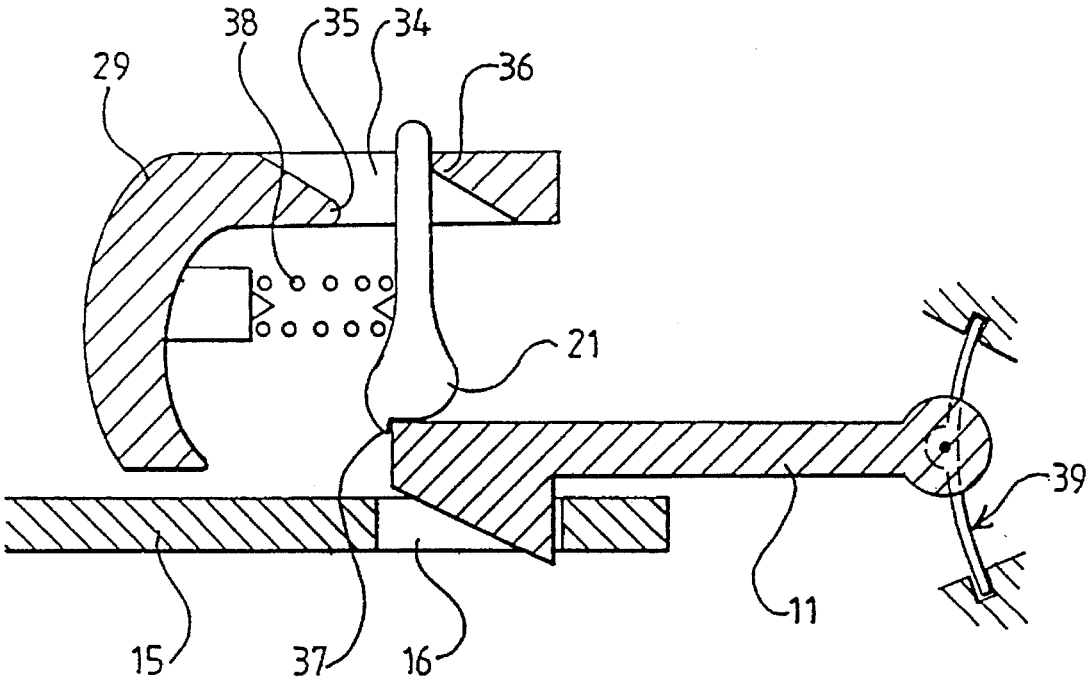

The modified arrangements shown in FIGS. 10 and 11 illustrate ways in which this can be effected. In both of the modified arrangements of FIGS. 10 and 11 the lever 21 can move (rotate anti-clockwise) and reach a certain velocity under the influence of a sudden high g-force, this movement of the lever at the point where it comes into engagement with the push button 29 providing a dynamic force which counteracts the dynamic force resulting from the movement of the push button. In this way the dynamic forces can be "balanced".

In the arrangements of both FIG. 10 and FIG. 11 the lever 21 engages a movable stop 37 when it is in the locking position, the lever being urged against the stop by means of a spring 38 which extends between the push button 29 and a lower part of the lever 21 beneath its pivot point. The spring 38 therefore imparts a torque upon the lever 21 tending to rotate the lever in an anti-clockwise direction. The stop 37 is itself acted upon by spring means 39 which urge the stop to the left in the drawings. Thus the spring means 39 impart a torque upon the lever 21 which would tend to rotate the lever in a clockwise direction. The torque exerted by the spring means 39 is greater than that exerted by the spring 38 so that under normal circumstances the stop 37 may be regarded as a fixed stop against which the lever 21 is urged by the spring 38. If, however, the lever and the push button are acted upon by a sudden high g-force then movement of the push button towards the right in the drawings results in compression of the spring 38 so that a greater torque is exerted upon the lever 21 by that spring as a result of its compression. Simultaneously the stop 37 will tend to move to the right under the action of the high g-force against the action of the spring means 39. This movement of the stop 37 allows the lever 21 to rotate in an anti-clockwise direction under the action of the spring 38 so that the upper end of the lever 21 is already moving with a certain velocity when it comes into engagement with the contact surface 35 of the push button 29 and the dynamic forces of the moving lever and the moving push button counteract each other.

The precise nature of the stop 37 and the spring means 39 are different in the two versions shown in FIGS. 10 and 11. In FIG. 10 the stop 37 is constituted by a component fixed to the ejector 17 for the tongue 15. The ejector 17 is, as explained above, a spring-biased ejector and the spring means 29 may therefore comprise the spring which normally acts upon the ejector. In FIG. 11 the stop is constituted by one edge of the main locking element 11 engaging a small projection on the base of the lever 21. In this case the main locking element 11 is mounted in the housing so as to be movable in the axial direction of the buckle, the pivot mounting for the main locking element 11 being acted upon by a leaf spring of the like which constitutes the spring means 39.

We claim:

1. A safety belt buckle for receiving and retaining a tongue mounted on the safety belt, comprising:

a housing defining a path therein to receive the tongue;

a main locking element located in the path, attached to said housing, and being movable between a release position in which said main locking element does not engage the tongue, and a locking position in which said main locking element engages the tongue to retain the tongue in the buckle;

a push button movable essentially parallel to a longitudinal axis of the path and being positioned above said main locking element;

a second locking element mounted to said housing between said push button and said main locking element, and having a first portion engagable by said push button, and a second portion movable along the longitudinal axis of the path to a first position to engage the main locking element when said main locking element is in the locking position to prevent movement of the main locking element to the release position, the second portion and said push button being movable along the longitudinal axis of the path in opposite directions when the main locking element is to be released so that the second portion is moved to a second position in which the main locking element is freed so as to be movable to the release position;

wherein when said second portion is in the first position, said first portion of said second locking element is engaged by and limits movement of the push button if the buckle is subjected to a g-force acting in a first direction, and said push button engages with and prevents movement of the second locking element if the buckle is subjected to a g-force acting in a second direction opposite to said first direction.

2. A safety belt buckle according to claim 1, wherein the push button and the second locking element engage each other at different, spaced apart contact points when the buckle is subjected to g-forces acting in said first and said second directions, said contact points each allowing for different mechanical advantages.

3. A safety belt buckle according to claim 1 wherein the second locking element comprises a pivoting lever.

4. A safety belt buckle according to claim 3, wherein a center of mass of the pivoting lever is offset from a pivot axis thereof, and when the buckle is subjected to g-forces acting in said first or said second directions, the pivoting lever is subjected to opposing torques acting about the pivot axis, the torques being generated by the engagement of the second locking element with the push button and by the mass of the second locking element.

5. A safety belt buckle according to claim 4, wherein, when the buckle is subjected to a g-force acting in said first direction, the torque exerted on the second locking element as a result of the mass of the second locking element is greater than the torque exerted on the second locking element by the engagement of the push button therewith.

6. A safety belt buckle according to claim 4, wherein, when the buckle is subjected to a g-force acting in said second direction, the torque exerted on the second locking element by the engagement of the push button therewith is greater than the torque exerted on the second locking element due to the mass of the second locking element.

7. A safety belt buckle according to claim 6, wherein the push button and the second locking element engage each other at different, spaced apart contact points when the buckle is subjected to g-forces acting in said first and second directions, said contact points allowing for different mechanical advantages, and wherein the contact point at which the push button engages the second locking element, when the buckle is subjected to a g-force in said second direction, is further away from the pivot axis of the second locking element than the contact point at which the second locking element is engaged by the push button when the buckle is subjected to a g-force in said first direction.

8. A safety belt buckle according to claim 1, wherein, when the buckle is subjected to a g-force acting in said second direction, the push button engages the second locking element via a surface of the second locking element which is not perpendicular to the direction of movement of the push button.

9. A safety belt buckle according to claim 8, wherein said surface of the second locking element is inclined to the direction of movement of the push button.

10. A safety belt buckle according to claim 8, wherein said surface of the second locking element to extends essentially in to the direction of movement of the push button.

11. A safety belt buckle according to claim 1, wherein, when the buckle is subjected to a g-force acting in said first direction, the push button is movable through a predetermined distance before engaging the second locking element.

12. A safety belt buckle according to claim 11, further comprising a stop element located within said housing; wherein the second locking element comprises a pivoting lever and wherein the second locking element is urged against said stop element using a spring when said second locking element is in the first position, the stop element being movable when subjected to a g-force acting in said first direction so as to permit movement of the second locking element under the action of the spring before said second locking element is engaged by the push button, the movement of the first portion of the second locking element being in the opposite direction to movement of the push button.

13. A safety belt buckle according to claim 12, further comprising spring means for biasing said stop element in a direction opposite to a bias imparted to the second locking element by the spring.

14. A safety belt buckle according to claim 12, wherein the spring extends between the push button and the second locking element.

15. A safety belt buckle according to claim 12, further comprising an ejector provided in the buckle for ejecting the tongue therefrom, said stop element being connected to said ejector.

16. A safety belt buckle according to claim 12, wherein the stop element forms a part of the main locking element, the main locking element being resiliently mounted within the housing of the buckle.

17. A safety belt buckle according to claim 1, wherein the second locking element includes a pin-like member which engages the main locking element when in the locking position and prevents movement of the main locking element to the release position, a part of the pin-like member being received in an aperture in a part of the buckle housing, for transmitting forces which tend to urge the main locking element to the release position into the housing.

18. A safety belt according to claim 17, wherein the second locking element comprises a pivoting lever and wherein the pin-like member is mounted adjacent one end of the lever, movement of the push button being transmitted to the pin-like member via the pivoting lever.

19. A safety belt buckle according to claim 18, wherein forces which tend to urge the main locking element to the release position are transmitted into the housing of the buckle at a position offset from a point where the pivoting lever is pivotally mounted in the housing, said forces being transmitted into the housing through the pin-like member and an edge of the aperture in which the part of the pin-like member is received.

20. A safety belt buckle according to claim 18, wherein the pin-like member is formed integrally with the pivoting lever.

21. A safety belt buckle according to claim 18, wherein the pin-like member is formed separately from the pivoting lever and is received within a recess defined by the lever.

* * * * *